US006945154B1

(12) United States Patent
Luth

(10) Patent No.: US 6,945,154 B1
(45) Date of Patent: Sep. 20, 2005

(54) FINNED CARBINE HANDGUARD ASSEMBLY

(76) Inventor: Randy E. Luth, 10944 147th Ave. SE., Becker, MN (US) 55308

( * ) Notice: Subject to any disclaimer, the term of this patent is extended or adjusted under 35 U.S.C. 154(b) by 0 days.

(21) Appl. No.: 10/758,159

(22) Filed: Jan. 15, 2004

(51) Int. Cl.[7] ..... F41A 13/12
(52) U.S. Cl. ..... 89/14.1; 89/96
(58) Field of Search ..... 89/14.1, 14.2; 42/85, 96, 105

(56) References Cited

U.S. PATENT DOCUMENTS

| | | | | |
|---|---|---|---|---|
| 1,379,339 | A * | 5/1921 | Haskell | 89/14.1 |
| 3,826,589 | A | 7/1974 | Frank et al. | |
| 3,845,755 | A | 11/1974 | Aske | |
| 4,536,982 | A | 8/1985 | Bredbury et al. | |
| 4,663,875 | A | 5/1987 | Tatro | |
| 4,663,876 | A | 5/1987 | Reaume | |
| 4,664,296 | A | 5/1987 | Dziki | |
| 5,010,676 | A * | 4/1991 | Kennedy | 42/71.01 |
| 5,198,600 | A | 3/1993 | E'Nama | |
| 5,590,484 | A | 1/1997 | Mooney et al. | |
| 5,768,819 | A * | 6/1998 | Neal | 42/96 |
| 5,826,363 | A | 10/1998 | Olson | |
| 6,427,372 | B1 * | 8/2002 | Howard et al. | 42/71.01 |
| 6,490,822 | B1 | 12/2002 | Swan | |
| 6,499,245 | B1 | 12/2002 | Swan | |
| 6,516,550 | B1 * | 2/2003 | Schnyder et al. | 42/96 |
| 6,609,321 | B2 | 8/2003 | Faifer | |
| 2003/0074822 | A1 | 4/2003 | Faifer | |
| 2003/0103252 | A1 | 6/2003 | Liu et al. | |

FOREIGN PATENT DOCUMENTS

GB 2 168 795 A * 6/1986

* cited by examiner

*Primary Examiner*—Stephen M. Johnson
(74) *Attorney, Agent, or Firm*—McKee, Voorhees & Sease, P.L.C.

(57) ABSTRACT

A gun barrel handguard includes half sections having longitudinally spaced apart fins of plastic material positioned around the exterior of the gun barrel for absorbing heat but preventing it from being quickly transmitted to the exterior of the handguard.

8 Claims, 3 Drawing Sheets

FINNED CARBINE HANDGUARD ASSEMBLY

BACKGROUND OF THE INVENTION

Rapid firing of a rifle produces substantial heat which must be dissipated in a controlled manner to prevent damage to the weapon and injury to the hand of the person holding the gun. Representative of current hand guards is the handguard shown in FIG. 2 which includes a plastic outer shell with an internal metallic liner spaced from the barrel of the gun to absorb the heat produced.

What is needed is a handguard which will absorb more heat faster and yet protect the user's hands.

BRIEF SUMMARY OF THE INVENTION

The handguard of this invention utilizes no metallic liner but instead provides hand guard half sections made entirely of plastic material with radially extending fins on the inner side wall that function to absorb the heat generated by the gun barrel.

The preferred material is a glass fiber reinforced polyamide (thermoplastic) with good impact resistance, high strength, and a high melting point (590° F. minimum). Additives are to be used for increased heat stabilization, heat aging resistance, and lubrication.

The fins in the handguards serve a dual purpose. They draw heat away from the barrel and provide additional strength and rigidity to the part. Holes are located in the top of each handguard to provide additional air flow to the barrel.

Testing has proved that finned handguards remain comfortable to touch during and after full-auto fire (210 rounds) of an M-16 rifle. After firing, only very minor signs of melting or charring around the front area for the gas tube were evident. This did not adversely affect or diminish the function of the handguards. In comparison, conventional commercial plastic handguards without aluminum heat shields were rendered useless after the same testing. Only the plastic handguards with double metal heat shields were as effective as the finned handguards.

DETAILED DESCRIPTION OF THE PREFERRED EMBODIMENT

Figure 1:
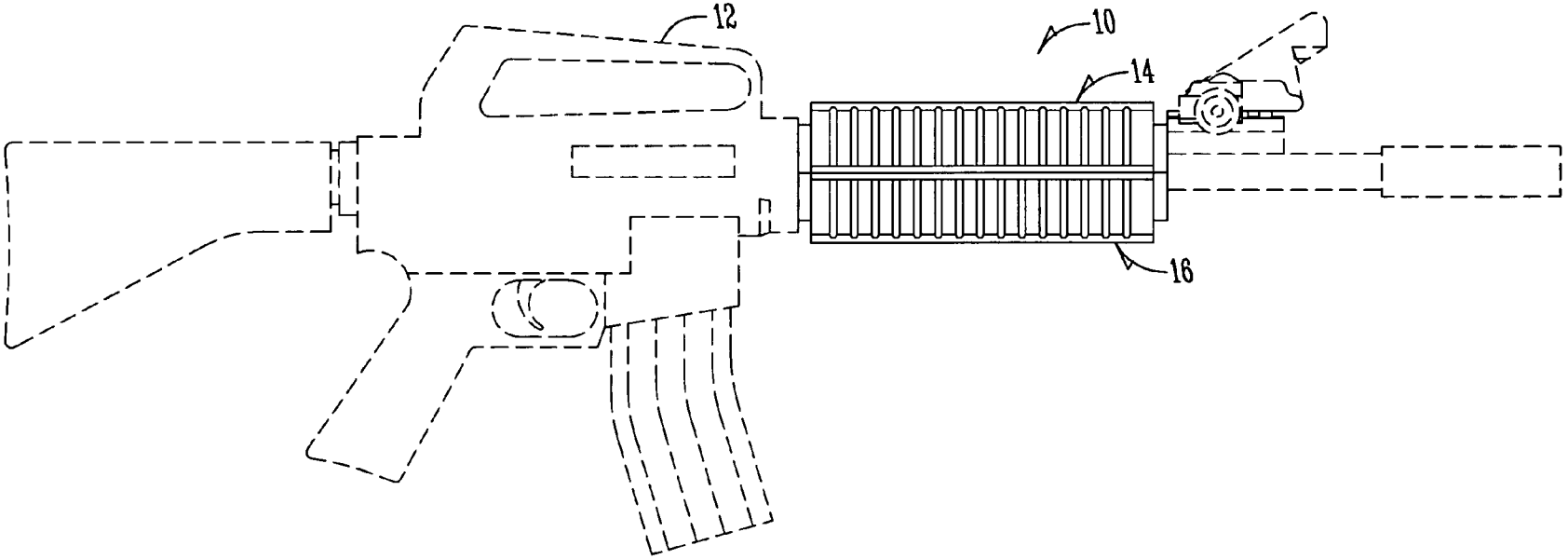
FIG. 1 is a side elevation view of an M-16 weapon showing the handguard of this invention mounted thereon.
Figure 2:
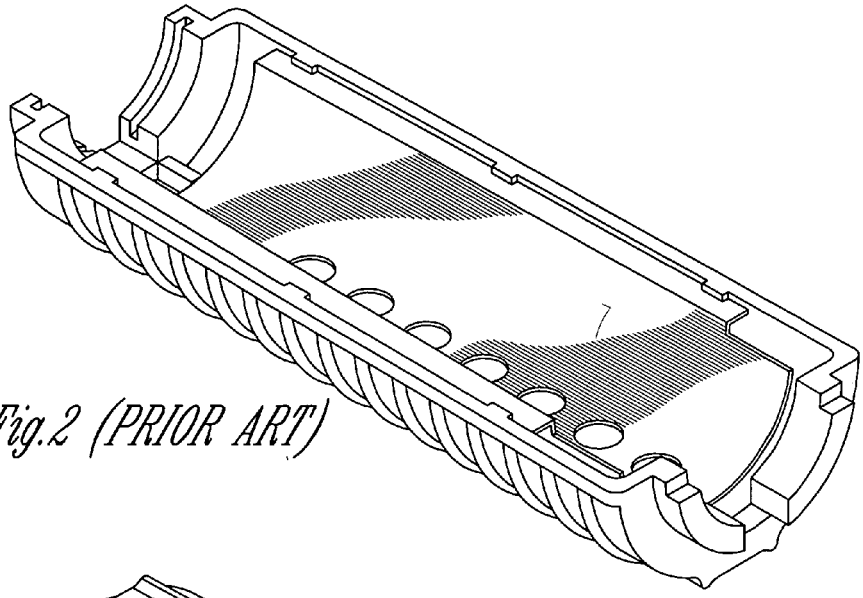
Fig.2 (PRIOR ART)
FIG. 2 is a perspective view of a half section of a prior art handguard employing an aluminum metal liner.
Figure 3:
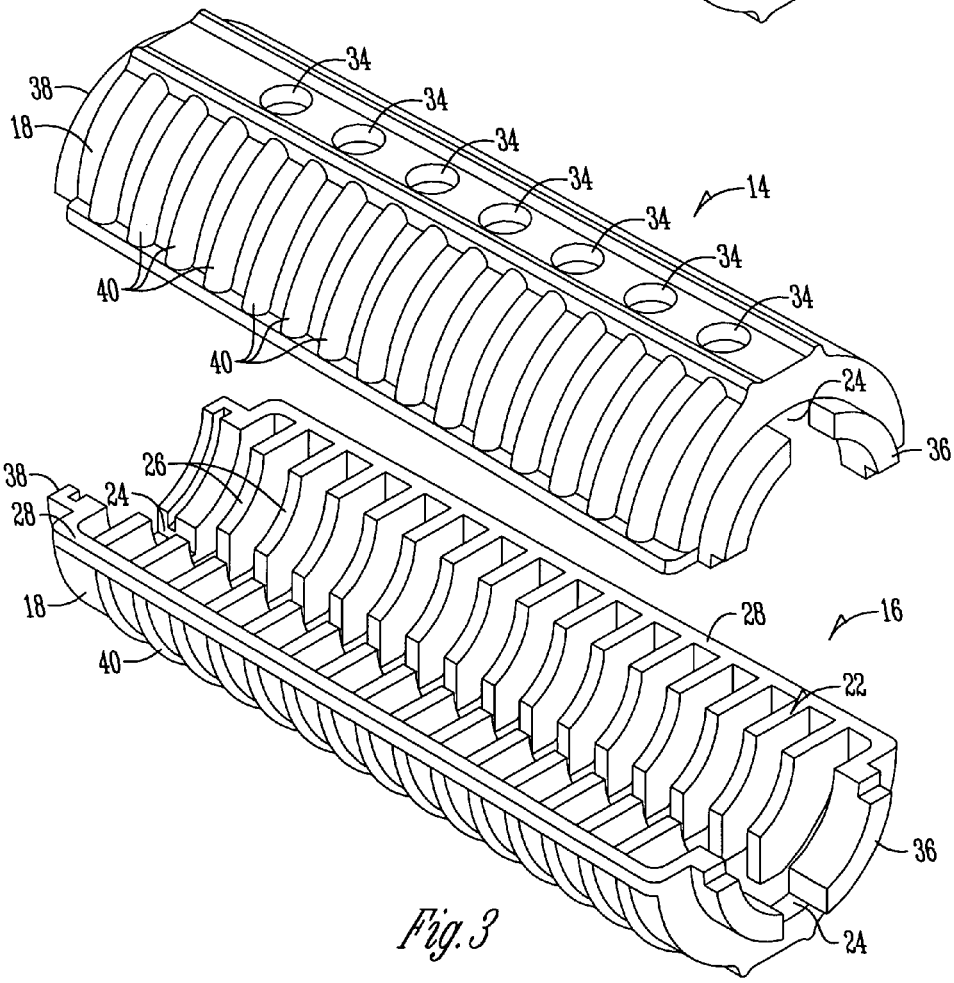
FIG. 3 is an exploded perspective view of the handguard half sections in position to be attached to the barrel of a gun.
Figure 4:
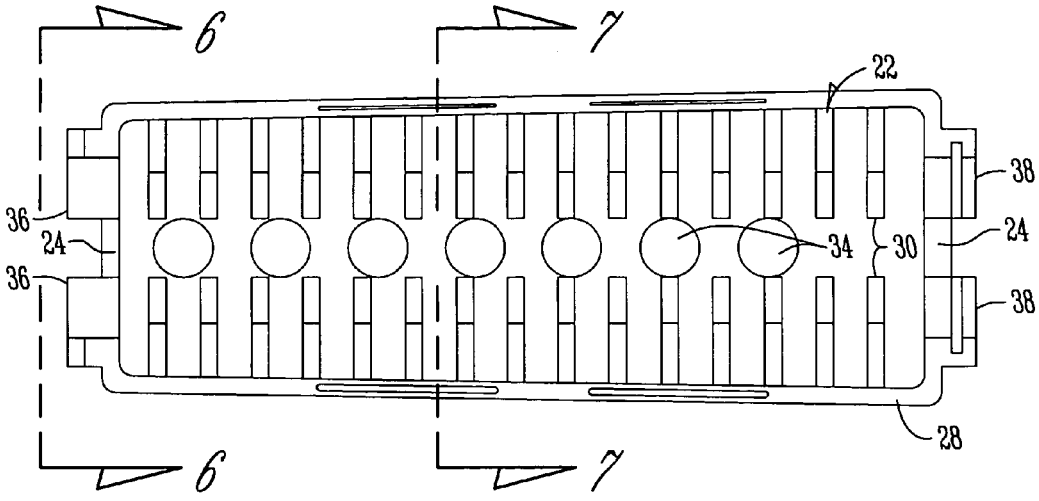
FIG. 4 is a top plan view of one of the half sections.
Figure 5:
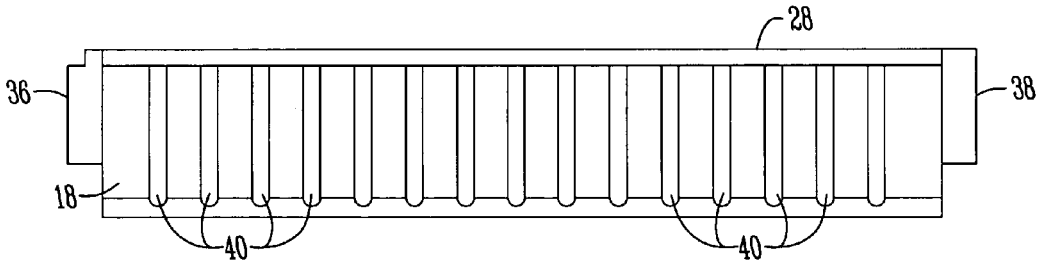
FIG. 5 is a side elevation view thereof.
Figure 6:
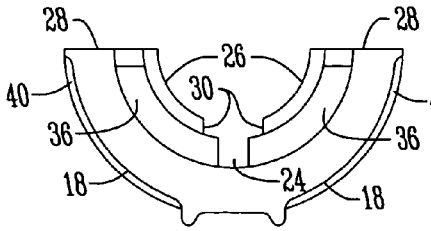
FIG. 6 is an end elevation view taken along 6—6 in FIG. 4.
Figure 7:
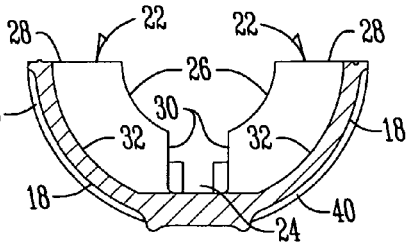
FIG. 7 is a cross sectional view taken along lines 7—7 in FIG. 4.

The handguard of this invention is referred to generally in FIG. 1 by the reference numeral 10 and is shown mounted on an M-16 rifle 12.

The handguard 10 includes upper and lower half sections 14 and 16. Each of the half sections include a semi-cylindrical or oval shaped outer wall 18 having an inner surface 32 on which is mounted a plurality of coplaner fin portions 22. The fin portions are spaced apart along their inner free ends to form a channel 24 for a gas tube (not shown).

Each of the fin portions include an inner concave edge 26 having at its opposite ends straight edges 28 and 30 which extend to the inner surface 32 of the wall 18. The concave edges 26 when mounted on the barrel of a gun will be in spaced relationship thereto to avoid interfering with the operation of the weapon but close enough to absorb heat produced during the firing of the gun.

A series of air circulation holes 34 are provided between the fin portions 22 in the channel wall 18.

Opposite ends of the half sections include mounting shoulders 36 at the forward end and 38 at the rear end. A cap or clamp (not shown) engages the shoulders to hold the handguard on the gun barrel.

The exterior of the half sections 14 and 16 include longitudinally spaced apart annular shoulders 40 to facilitate gripping of the weapon.

Thus in operation it is seen that the handguard half sections of this invention when mounted on the barrel of a gun will absorb heat into the fins positioned around the barrel but due to the low conductivity of the plastic material used the heat will not be transmitted quickly to the exterior surface thus avoiding discomfort to the users hands.

What is claimed is:

1. A finned carbine handguard assembly comprising:

a pair of half sections adapted to be mounted on and around a gun barrel, and each of said half sections including an outer wall including inner and outer surfaces and having on the inner surface along the substantial length of the outer wall spaced apart fins extending radially inwardly toward the axial center of said half sections for conducting heat away from said gun barrel, said fins being comprised of a non metallic material capable of absorbing heat and slowly conducting said heat radially outwardly away from said gun barrel, each of the fins of one of said half sections including two coplanar fin portions spaced apart to form a longitudinally extending channel therebetween adapted for a gas tube, said fin portions having inner free end edges concave in shape for embracing a gun barrel in spaced relationship thereto, said concave free end edges of said fin portions terminating at their opposite ends in straight edges extending to said outer wall, and said outer wall between said fin portions and in said channel including a plurality of openings for air circulation.

2. An internally finned carbine handguard assembly comprising:

a pair of half sections adapted to be mounted on and around a gun barrel, and each of said half sections including an outer wall including inner and outer surfaces and having on the inner surface along the substantial length of the outer wall closely spaced apart fins extending radially inwardly toward the axial center of said half sections, the opposite sides of each of said fins providing substantial surface area for absorbing heat from said gun barrel and conducting the heat away from the gun barrel;

said fins being comprised of a non metallic material capable of absorbing heat and slowly conducting said heat radially outwardly away from said gun barrel;

each of the fins of one of said half sections including two coplanar fin portions spaced apart to form a longitudinally extending channel therebetween; and said fin portions having inner free end edges concave in shape for embracing said gun barrel in closely spaced relationship thereto.

3. The internally finned carbine handguard assembly of claim 2 wherein said non metallic material is further defined as being plastic.

4. The internally finned carbine handguard assembly of claim 3 wherein said non metallic material is further defined as being a glass fiber reinforced polyamide.

5. The internally finned carbine handguard assembly of claim 2 wherein the entirety of said assembly is made from a non metallic material.

6. The internally finned carbine handguard assembly of claim 2 wherein said concave free end edges of said fin portions terminate at their opposite ends in straight edges extending to said outer wall.

7. The internally finned carbine handguard assembly of claim 6 wherein said outer wall between said fin portions and in said channel includes a plurality of openings for air circulation.

8. The internally finned carbine handguard of claim 2 wherein each of said half sections are either semi cylindrical or oval.

* * * * *